US009181001B2

(12) United States Patent
Molinaro et al.

(10) Patent No.: US 9,181,001 B2
(45) Date of Patent: Nov. 10, 2015

(54) TAMPER-EVIDENT CONTAINER CAP AND NECK FINISH

(71) Applicant: Omega Cap Solutions LLC, Naples, FL (US)

(72) Inventors: Luca Molinaro, New Castle, PA (US); Robert E. Crisci, Naples, FL (US)

(73) Assignee: Omega Cap Solutions LLC, New Castle, PA (US)

( * ) Notice: Subject to any disclaimer, the term of this patent is extended or adjusted under 35 U.S.C. 154(b) by 0 days.

(21) Appl. No.: 14/582,574

(22) Filed: Dec. 24, 2014

(65) Prior Publication Data

US 2015/0191280 A1 Jul. 9, 2015

Related U.S. Application Data

(63) Continuation of application No. 13/198,019, filed on Aug. 4, 2011, now abandoned.

(60) Provisional application No. 61/370,656, filed on Aug. 4, 2010, provisional application No. 61/414,680, filed on Nov. 17, 2010.

(51) Int. Cl.

| | |
|---|---|
| ***B65D 41/34*** | (2006.01) |
| ***B65D 1/02*** | (2006.01) |
| *B65D 41/36* | (2006.01) |

(52) U.S. Cl.

CPC ..... *B65D 41/3447* (2013.01); *B65D 1/023* (2013.01); *B65D 1/0246* (2013.01); *B65D 41/3409* (2013.01); *B65D 2101/0046* (2013.01)

(58) Field of Classification Search

CPC ..... B65D 41/3404; B65D 41/3409; B65D 41/3442; B65D 41/3447; B65D 1/0246; B65D 1/023

USPC ..... 215/253, 254, 44, 252, 330, 343

See application file for complete search history.

(56) References Cited

U.S. PATENT DOCUMENTS

| | | | |
|---|---|---|---|
| 3,874,540 | A | 4/1975 | Hidding |
| 3,980,195 | A | 9/1976 | Fillmore |
| 4,062,466 | A | 12/1977 | Conti |
| 4,497,765 | A | 2/1985 | Wilde et al. |
| 4,534,480 | A | 8/1985 | Santostasi et al. |
| 4,561,553 | A | 12/1985 | Crisci |
| 4,589,561 | A | 5/1986 | Crisci |

(Continued)

*Primary Examiner* — Mickey Yu
*Assistant Examiner* — Niki Eloshway
(74) *Attorney, Agent, or Firm* — Alan G. Towner, Esq.; Pietragallo Gordon Alfano Bosick & Raspanti, LLP

(57) ABSTRACT

A tamper-evident cap is disclosed having a circular closure member, a cylindrical annular wall depending generally from the periphery of the closure member terminating with a base and having a plurality of serrations, and a tamper-evident band circumferentially positioned around the base having teeth and attached to a portion of the base. The tamper-evident band may be mounted to the base by at least one of the teeth or attached by at least one of the serrations extending below the base. The interior and/or exterior of the cylindrical wall may be stepped. The tamper-evident band may have a groove between the teeth for retaining the tamper-evident band on a neck finish. A neck finish having at least one set of teeth and optional raised portions for securing the tamper-evident band in place is also disclosed. The neck finish may be stepped to correspond with a cap having a cylindrical wall with a stepped interior. A cap and neck finish combination for a container is also disclosed.

11 Claims, 9 Drawing Sheets

(56) References Cited

U.S. PATENT DOCUMENTS

| | | | |
|---|---|---|---|
| 4,625,875 | A | 12/1986 | Carr et al. |
| 4,658,977 | A | 4/1987 | Crisci |
| 4,667,839 | A | 5/1987 | Crisci |
| 4,687,114 | A | 8/1987 | Crisci |
| 4,722,447 | A | 2/1988 | Crisci |
| 4,785,952 | A | 11/1988 | Obadia |
| 4,830,207 | A | 5/1989 | Battegazzore |
| 4,884,707 | A | 12/1989 | Crisci |
| 4,938,370 | A | 7/1990 | McBride |
| 5,009,323 | A | 4/1991 | Montgomery et al. |
| 5,103,991 | A | 4/1992 | Collins |
| 5,104,008 | A | 4/1992 | Crisci |
| 5,105,960 | A | 4/1992 | Crisci et al. |
| 5,190,178 | A | 3/1993 | Luch |
| 5,213,224 | A | 5/1993 | Luch |
| 5,249,695 | A | 10/1993 | Luch et al. |
| 5,267,661 | A | 12/1993 | Luch et al. |
| 5,285,912 | A | 2/1994 | Molinaro |
| 5,303,838 | A | 4/1994 | Luch et al. |
| 5,307,945 | A | 5/1994 | Hidding et al. |
| 5,307,946 | A | 5/1994 | Molinaro |
| 5,346,082 | A | 9/1994 | Ochs et al. |
| 5,415,306 | A | 5/1995 | Luch et al. |
| 5,456,376 | A | 10/1995 | Luch et al. |
| 5,465,876 | A | 11/1995 | Crisci |
| 5,480,045 | A | 1/1996 | Molinaro et al. |
| 5,553,727 | A | 9/1996 | Molinaro |
| 5,597,082 | A | 1/1997 | Luch et al. |
| 5,829,613 | A | 11/1998 | Wohlgemuth et al. |
| 6,003,701 | A | 12/1999 | Hidding et al. |
| 6,306,330 | B1 | 10/2001 | Cerny |
| 6,523,710 | B1 | 2/2003 | Hidding et al. |
| 8,091,724 | B2 | 1/2012 | King |
| 2002/0134747 | A1 | 9/2002 | Babcock et al. |
| 2005/0252878 | A1 | 11/2005 | Babcock |
| 2007/0034590 | A1 | 2/2007 | Hidding |
| 2007/0034591 | A1 | 2/2007 | Flak, Jr. et al. |
| 2007/0051691 | A1 | 3/2007 | Hidding |
| 2009/0283492 | A1 | 11/2009 | Molinaro et al. |

TAMPER-EVIDENT CONTAINER CAP AND NECK FINISH

CROSS-REFERENCE TO RELATED APPLICATIONS

This application is a continuation of U.S. application Ser. No. 13/198,019 filed on Aug. 4, 2011, which claims the benefit of U.S. Provisional Application Nos. 61/370,656 filed on Aug. 4, 2010 and 61/414,680 filed on Nov. 17, 2010, all of which are incorporated herein by reference.

TECHNICAL FIELD

The present invention relates to closure devices and, more particularly, to tamper-evident caps for containers.

BACKGROUND

Various types of caps have been used for removably sealing containers, such as blow molded or injection molded bottles. One such cap has spiral threads extending along an interior surface which threads match corresponding threads along an exterior surface of a bottle neck. Such caps may also have a tamper-evident band projecting outward along a lower rim of the cap to show evidence if the cap has been removed or otherwise tampered with. The rim can be helpful for positioning the band circumferentially around the cap, but it can also add to the bulk and weight of the cap. Further, the threads along the cap interior surface can be long thus requiring significant rotation to securely apply and attach the cap to the bottle neck.

SUMMARY

Embodiments of the present disclosure are generally directed to a tamper-evident cap and a corresponding neck finish for a container. In embodiments, the cap includes a circular closure member, a cylindrical wall depending from the closure and having serrations, and a tamper-evident band. In embodiments, the interior and/or exterior of the cylindrical wall may be stepped or stacked. In other embodiments, the tamper-evident band has teeth diverted inwardly to mesh with teeth on the neck finish and is circumferentially positioned around a base of the cylindrical wall with at least one of the teeth mounted to the base. Optionally the band is attached to the base by at least one serration that extends below the base of the cylindrical wall. In further embodiments, the tamper-evident band may have a groove between the teeth to assist with retaining the tamper-evident band on the neck finish of the container. The cap may have a sealing plug or a liner on the underside. The cylindrical wall has a threaded inner surface in a manner to cooperate and removably engage with threads of a neck finish of a container. In one embodiment, at least one of the threads of the interior wall of the cap has a bulbous portion.

Other embodiments of the invention are directed to an open end portion or neck finish of a container. In embodiments, the neck finish is formed from a cylindrical wall that defines an opening therethrough. The cylindrical wall includes a first end portion that is open to the outside and adapted to fit a cap, a second end portion that terminates at the container body, and at least one set of ratchet teeth positioned around a portion of an outer surface of the cylindrical wall at the second end. The cylindrical wall of the neck finish may be stepped to correspond with a stepped interior of the cap. In one embodiment, at least one of the ratchet teeth has a raised portion either on top or adjacent to aid in retaining the tamper-evident band of the cap. In other embodiments, multiple threads are angularly positioned on the exterior of the cylindrical wall between the first end and the second end to mate with corresponding threads formed along the interior of the cap. In embodiments, at least one of the threads of the neck finish has a bulbous or wider portion to ease positioning of the cap on the container.

In embodiments the cap and the neck finish have multiple threads and multiple leads to enable the cap to lock onto the neck finish by rotating the cap less than a full turn. In an example, the cap may be securely fit to the neck finish using less than 75 degrees rotation. The threading may also decrease the amount of resin material needed in the cap construction.

In embodiments, the tamper-evident band has a scalloped body configured to strengthen support for the cap. The strength may ease automated application of the cap to a neck finish. The scalloped body may be of a smaller overall size and, therefore, may require less resin material.

A cap and neck finish combination is also embodied herein.

Those and other details, objects, and advantages of the present invention will become better understood or apparent from the following description and drawings showing embodiments thereof.

BRIEF DESCRIPTION OF THE DRAWINGS

The accompanying drawings illustrate examples of embodiments of the present invention.

DETAILED DESCRIPTION

Figure 1A:
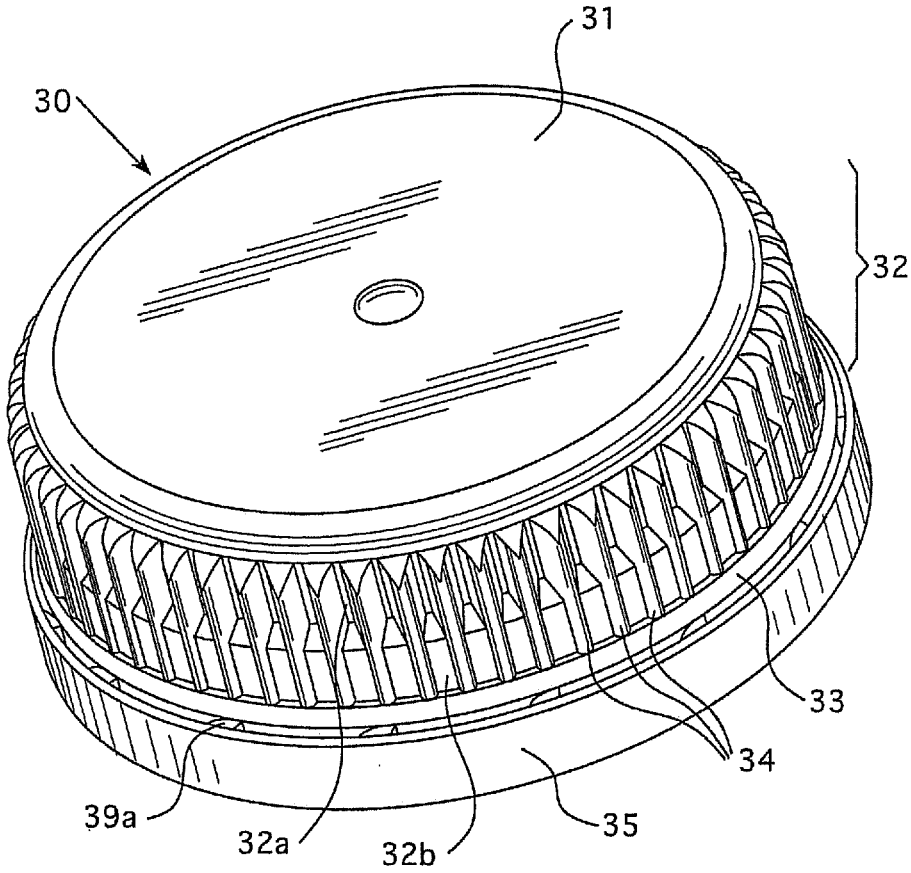
FIGS. 1A-1E show a top perspective view of a cap with a stepped exterior cylindrical wall and unbroken serrations (FIG. 1A), a top perspective view of a cap with a stepped exterior cylindrical wall and broken serrations (FIG. 1B), a side view of a cap with a straight exterior cylindrical wall (FIG. 1C), a bottom perspective view of a cap with a sealing plug (FIG. 1D), and a bottom perspective view of a cap with a liner (FIG. 1E) according to embodiments of the present invention.
Figure 1B:
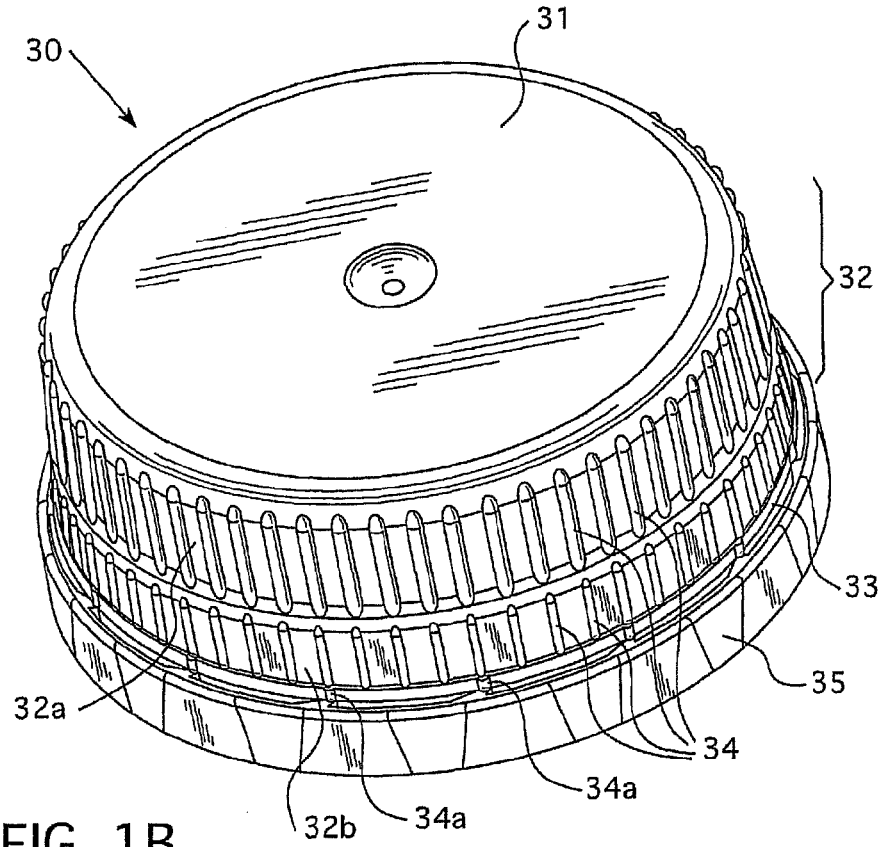
Figure 1C:
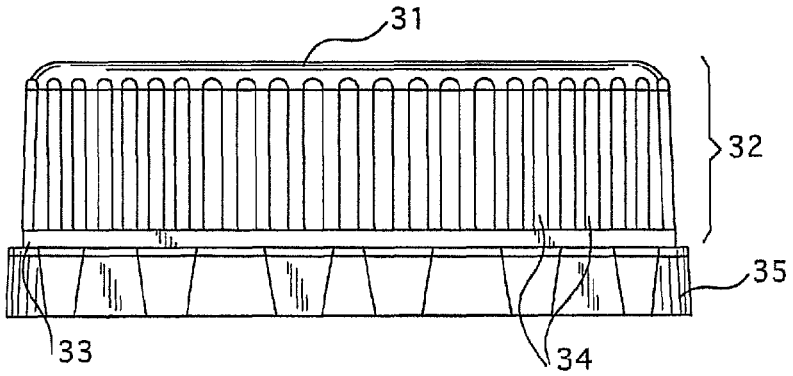
Figure 1D:
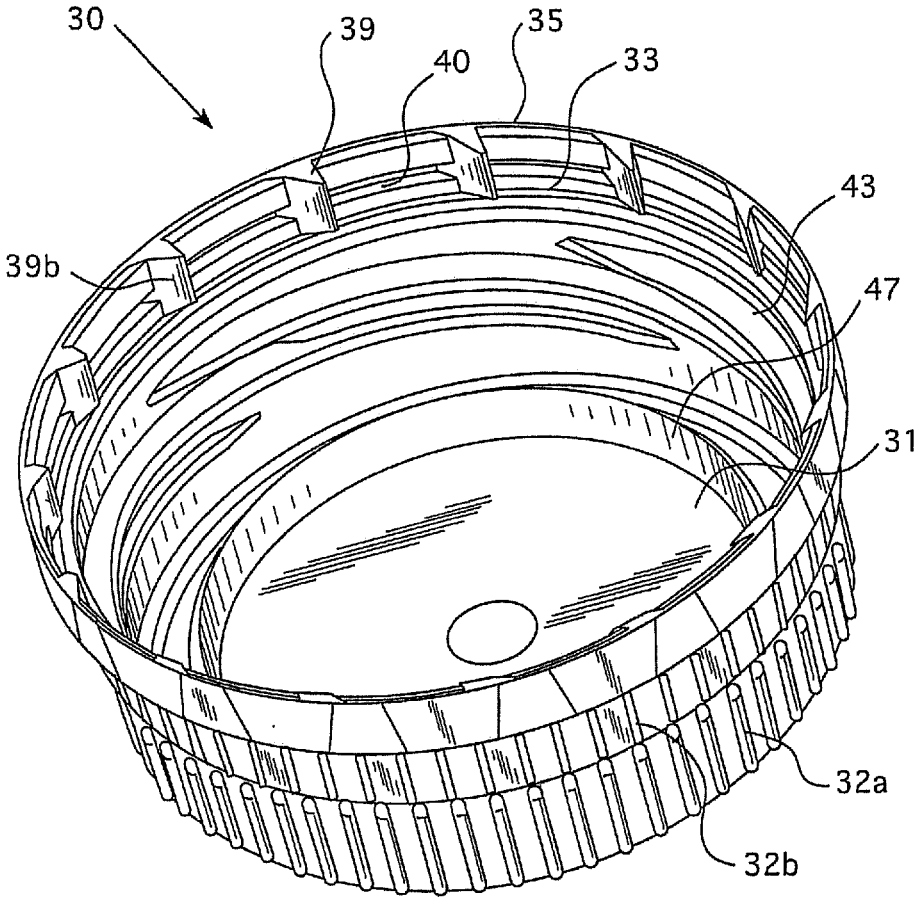
Figure 1E:
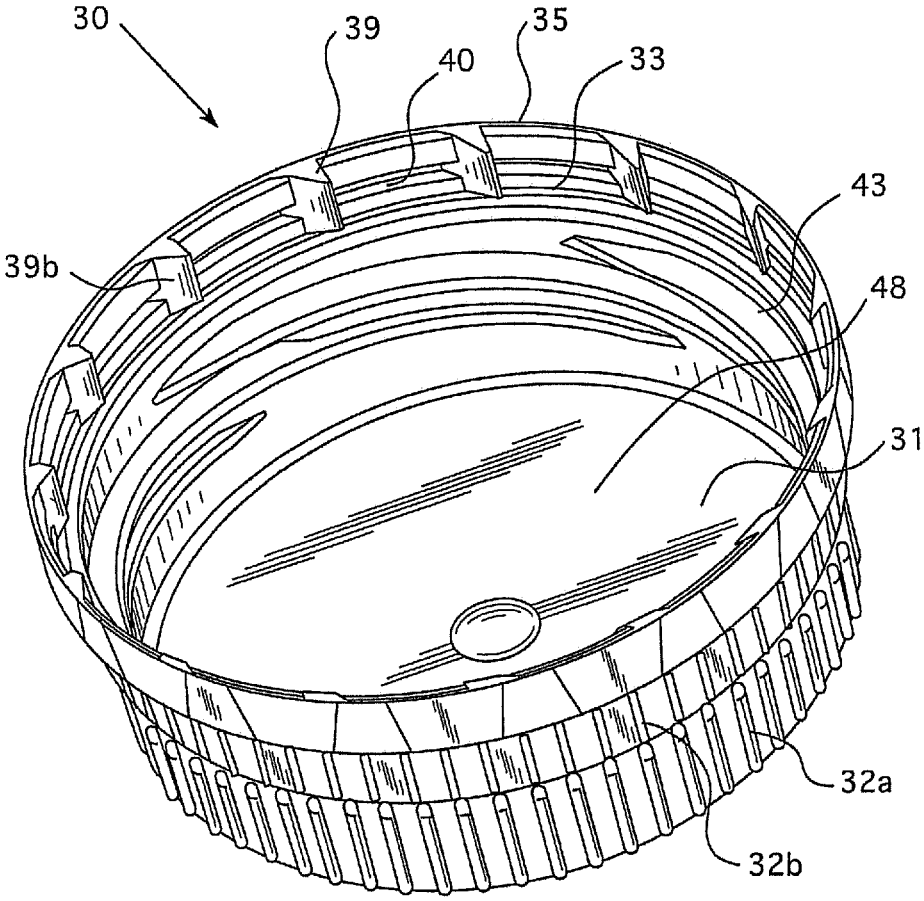

Various embodiments of the invention include a cap 30 that can be used to seal a container. See, for example, FIGS. 1A-E. The cap 30 has a circular closure member 31 and an annular cylindrical wall 32 depending from the perimeter of closure member 31. The cylindrical wall 32 has a first portion 32*a* located adjacent to closure member 31 and an adjoining second portion 32*b* that terminates with a base 33. The base 33 may be the bottom end wall of second portion 32*b* or a solid ring and useful for positioning the cap 30. See FIG. 1A-1C. The cylindrical wall 32 may have a straight (FIG. 1C) or a stepped interior and/or exterior shape (FIGS. 1A, 1B, 1D, and 1E), e.g. the second portion 32*b* has a slightly larger circumference than the first portion 32*a*. In examples, cylindrical wall 32 has a stepped exterior shape and a stepped interior shape as illustrated in FIG. 1D. In other examples, cylindrical wall 32 has a straight exterior (FIG. 1C) and a stepped interior shape. The straight exterior cylindrical wall may have an outer diameter that is generally uniform or slightly tapered outward from closure member 31 to have a larger diameter near base 33. The stepped interior shape of the cylindrical wall 32 of cap 30 permits the cap 30 to self-center on a corresponding neck finish 50 of the container during the capping process. See FIG. 2. The cap 30 may be made from plastic such as high or low density polyethylene, polypropylene or any other resilient material that is suitable for securing the cap 30 to a container.

A plurality of serrations 34 are positioned along the outer surface of the cylindrical wall 32. In examples, the serrations 34 are straight (FIG. 1A), e.g. thicker at the first portion 32*a* and thinner at the second portion 32*b*, or broken (FIG. 1B) to accommodate a stepped exterior cylindrical wall 32.

Figure 5A:
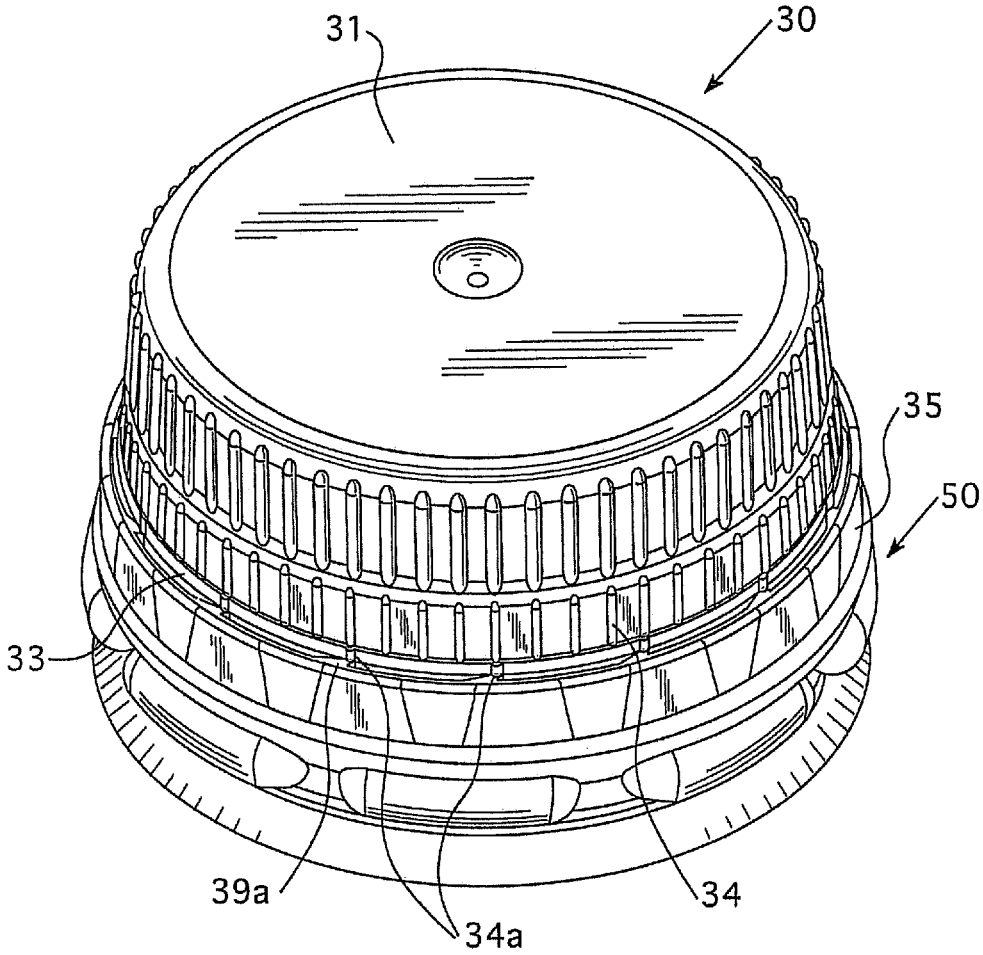
FIGS. 5A and 5B show a cap secured to a neck finish from a top perspective view (FIG. 5A) and with the cap partially cut away (FIG. 5B) according to embodiments of the present invention.

A tamper-evident band 35 is positioned beneath and attached to a portion of the base 33. The tamper-evident band 35 includes ratchet teeth 39 aligned along an interior surface shown for example in FIGS. 1D, 1E, 2, and 3. In an example, a portion of at least one of the teeth 39, such as the tip or inner most top 39*a*, is mounted directly to the base 33 as shown, for example, in FIG. 1A. In another example, the tamper-evident band 35 may attach to the cap 30 by at least one of the serrations 34*a* extending down past the base 33 as shown in FIGS. 1B and 5A. In an example and as shown in FIGS. 1B and 5A, every fourth serration 34*a* extends down to attach the tamper-evident band 35 to the base 33 of cap 30. The ratchet teeth 39 are adapted to engage the teeth 58 on the neck finish 50, as shown, for example, in FIG. 2, thereby retaining and preventing the tamper-evident band 35 from backing off the neck finish 50. Each tooth 39 has top 39*a* and an inner face 39*b* directed inwardly and positioned at an acute angle relative to the end. See FIGS. 1A and 1D.

The tamper-evident band 35 may also have an annular groove 40 between the ratchet teeth 39 to further retain the tamper-evident band 35 on the neck finish 50. See FIGS. 1D, 1E, and 3. In examples, groove 40 is an open snap groove. Groove 40 is wide enough to allow the tamper-evident band 35 to move vertically and float on or about raised portions, such as scallops 59 and pyramids 60, of the neck finish 50. See, for example, FIGS. 4A and 4B. In examples, groove 40 is about 0.01 to 0.3 inches wide, and preferably is about 0.021 inches. Groove 40 forms a snap bead locking the band 35 in place. The tamper-evident band 35 is resilient to slide over the raised portions, e.g. scallops 59 and pyramids 60, and/or the teeth 58 on the neck finish 50 without breaking. However, once applied to the neck finish 50, the tamper-evident band 35 should not back off the neck finish 50 of the container. Upon removal of the cap 30, the ratchet teeth 39 of the tamper-evident band 35 are brought up against the teeth 58 of the neck finish 50, until the tamper-evident band 35 disconnects from the base 33 or the serrations 34*a* break. See FIGS. 1A and 1C. The breaking of the connections may be audible, thereby providing audible evidence of tampering. Once the cap 30 is removed, the groove 40 continues to mate with the raised portions, e.g. scallops 59 and pyramids 60, and pushes the tamper-evident band 35 down and further prevents it from backing off, thereby retaining the tamper-evident band 35 on the neck finish 50. Once the tamper-evident band 35 is disconnected, a gap may result between the cap 30 and the tamper-evident band 35 when the cap 30 is reapplied, thereby providing further visual evidence of tampering. Absence of an attached tamper-evident band 35 also provides the user with visual evidence that the cap 30 has been tampered with or removed. This unique assembly of attaching the tamper-evident band 35 directly to the base 33 eliminates the need for a lower rim or lip typically found on container caps. The cap 30 designs allow for a smaller diameter of the tamper-evident band 35, less resin, easier molding, and therefore an overall cost reduction. The cap 30 can be manufactured by conventional molding, thereby avoiding the need for tools for slide mold.

Several helically spaced threads 43 are positioned on the inner surface of annular cylindrical wall 32. See FIGS. 1D, 1E, 2, and 3. Wall threads 43 can be generally tapered at the lead end 44 of a thread 43. See, for example, FIG. 2. For example, the cap 30 may have 1-20 threads. In one example, the cap 30 has 5 threads and multiple leads. Optionally, wall threads 43 may have a bulbous or wider portion 45. In an example of a cap having a stepped interior, the threads may start thinner and end thicker to accommodate the step. In an example, the cap 30 may be securely fit to the neck finish 50 using less than 75 degrees rotation. In examples, the starting thread is at an angle of about 72 degrees and a full thread rotation is about 150 degrees. This unique threading may also decrease the amount of resin material needed in the cap 30 construction.

Figure 2:
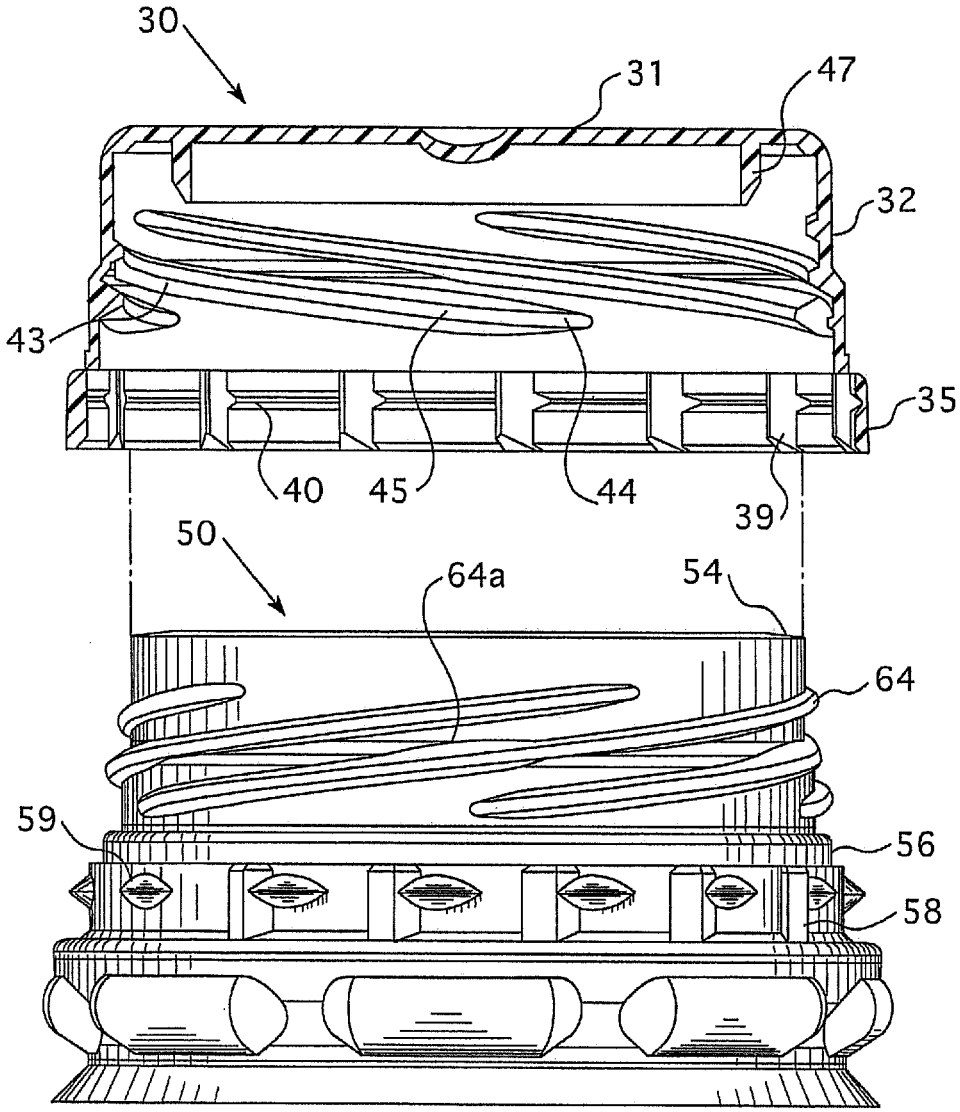
FIG. 2 shows a cross-sectional view of a cap and a perspective view of a bottle neck finish according to embodiments of the present invention.
Figure 3:
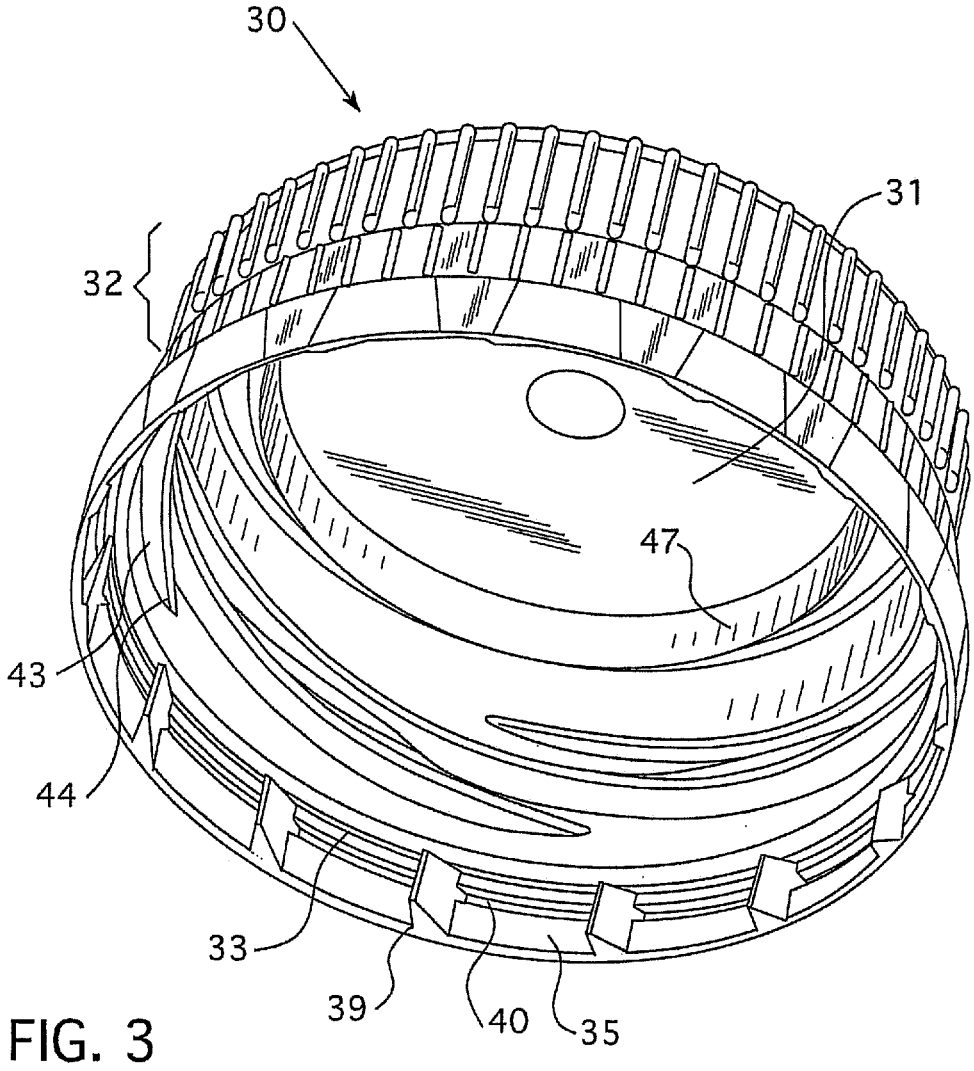
FIG. 3 shows a bottom perspective view of a cap according to embodiments of the present invention.
Figure 4A:
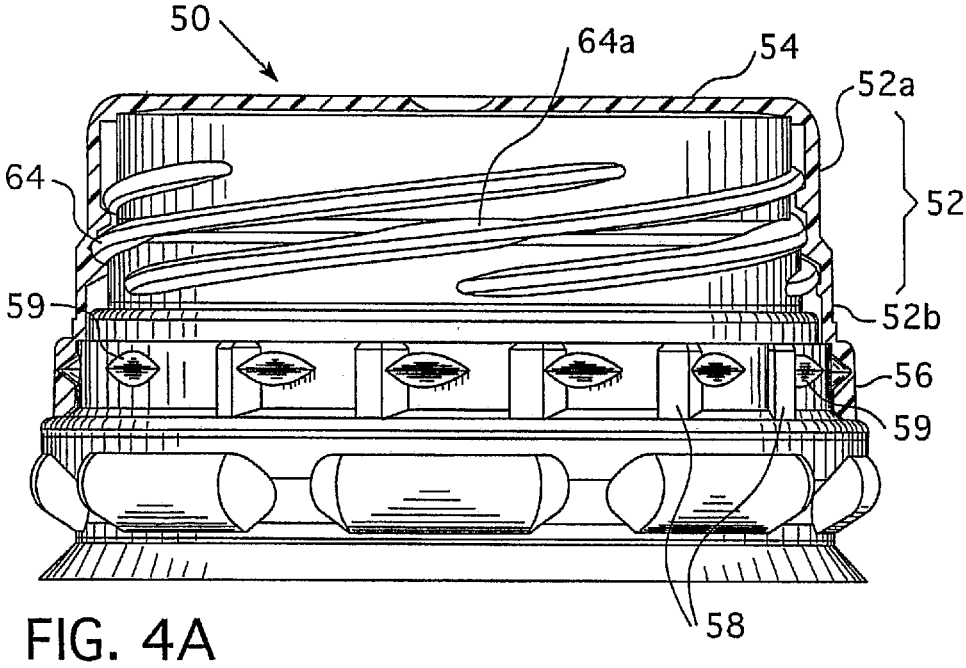
FIGS. 4A and 4B show a perspective view of a neck finish with scallops at the second end (FIG. 4A) and pyramids at the second end (FIG. 4B) according to embodiments of the present invention.
Figure 4B:
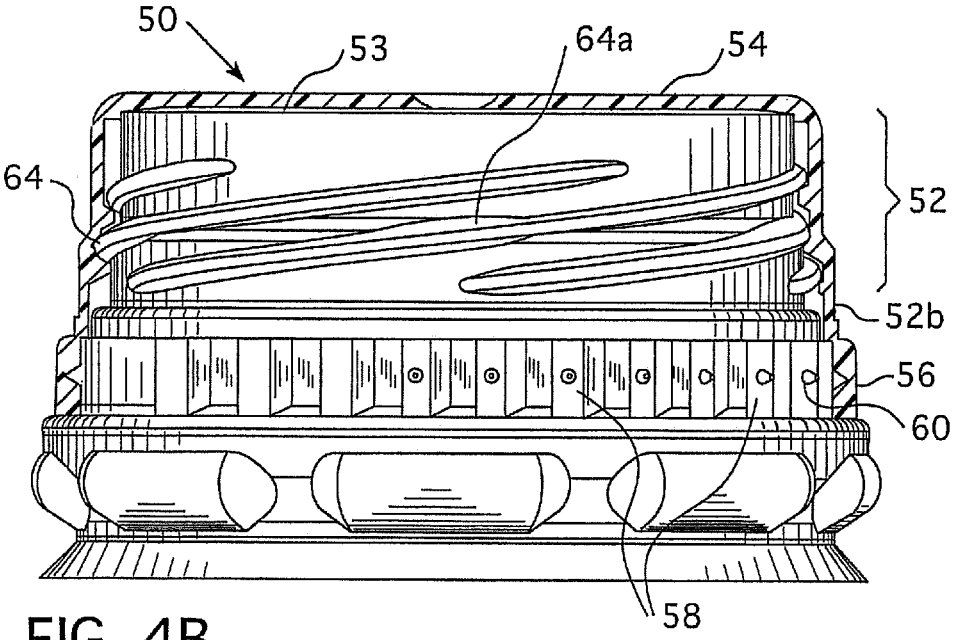
Figure 5B:
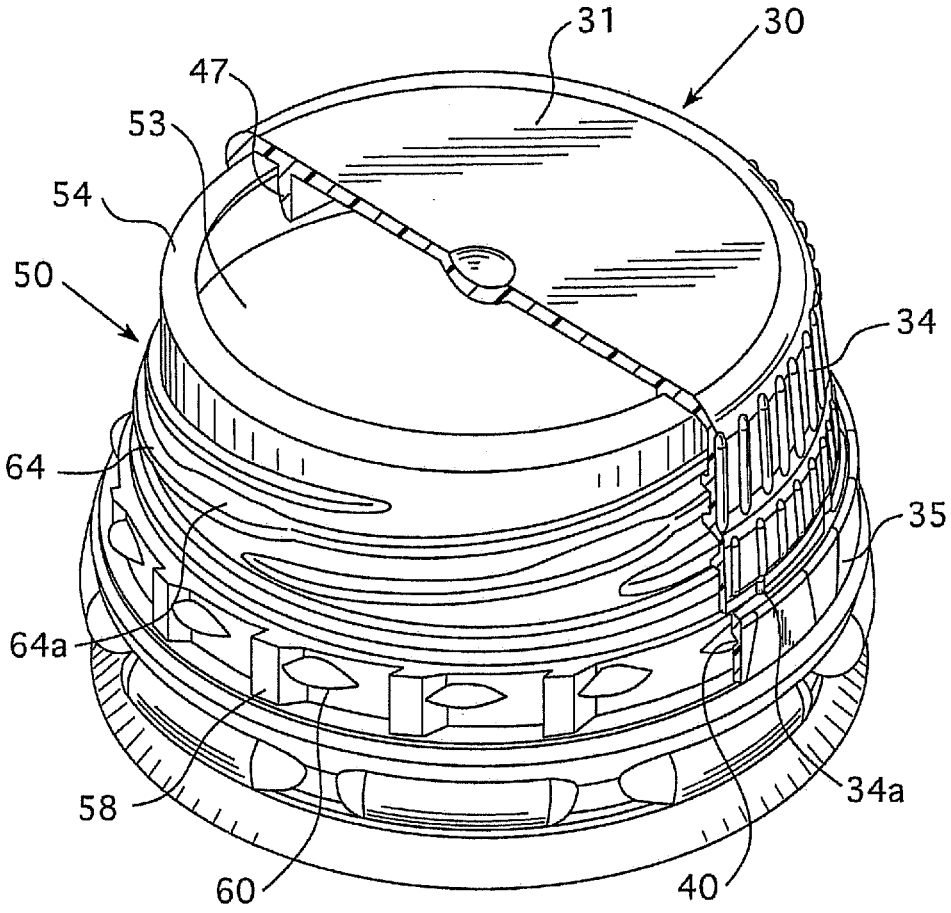

In various embodiments, the invention includes a cylindrical neck finish 50 shown for example in FIGS. 2 and 4. The neck finish 50 includes an annular wall 52 defining therethrough a cylindrical opening 53 (shown in FIGS. 4B and 5B) having a first end 54 and a second end 56. The first end 54 provides access to opening 53. The annular wall 52 of the neck finish 50 may be straight or stepped to correspond to the interior of the cylindrical wall 32 of the cap 30. In the example of a stepped neck finish 50, wall portion 52*a* has a smaller inner diameter than a wall portion 52*b*, to assist with location and help prevent cross-threading. See FIG. 4A. The neck finish 50 may be made of plastic such as high or low density polyethylene, polypropylene, or any material suitable for use with the contents of the container. The material may be the same as that of the container.

Helically extending along the exterior surface of the wall 52 and generally between the first end 54 and second end 56 are threads 64. Threads 64 are helically spaced in contiguous relationship as illustrated for example in FIGS. 2 and 4. In embodiments, each thread 64 extends around the circumference of annular wall 52 at a degree corresponding to that of the threads 43 of the cap 30. See, for example, FIG. 2. In examples, such as in FIGS. 4A and 4B, threads 64 have a bulbous portion 64*a*. Bulbous portion 64*a* may be formed from a gradual widening at the lead end of thread 64 to about a central location along the thread and fairly abruptly narrow to the end of the thread 64.

Positioned at the second end 56 of the neck finish 50 may be at least one set of annular ratchet teeth 58 to provide a grip or cooperatively engage the corresponding teeth 39 of the tamper-evident band 35 of the cap 30 and prevent the tamper-evident band 35 from backing off. See FIG. 2. Ratchet teeth 58 may be positioned around the entire circumference of the second end 56 of the neck finish 50 or only a portion thereof. In another embodiment, the second end 56 of the neck finish 50 may have a plurality of raised portions positioned around the entire circumference or a portion thereof. In one example, the raised portion may be scallops 59 and located adjacent and behind the ratchet teeth 58 as shown in FIG. 4A. In another example, the raised portion is pyramid shaped 60 and located on top of the ratchet teeth 58 as shown in FIG. 4B. The raised portions may be on top of, as shown with the pyramids 60 in FIG. 4B, or adjacent to, as shown with the scallops 59 in FIG.

4A, a corresponding ratchet tooth 58. Alternatively, the raised portions are positioned on the circumference absent a corresponding ratchet tooth 58. See the scallops 59 in FIGS. 2 and 4A. One or more ratchet teeth 58 may be eliminated to accommodate additional raised portions. The raised portions may have a larger diameter than the ratchet teeth 39 of the tamper-evident band 35 to assist with holding the tamper-evident band 35 in place. In an example, the raised portions, such as the scallops 59, mate with the groove 40 of the tamper-evident band 35 of the cap 30 to allow the tamper-evident band 35 to move vertically and also retain the tamper-evident band 35 on the neck finish after the cap 30 is twisted off. See FIG. 5B. This allows the consumer visual evidence of tampering. In this example, the ratchet teeth 39 of the cap 30 fit between the scallops 59 and the ratchet teeth 58 on the neck finish 50.

In another embodiment, the cap 30 may have an annular valve or sealing plug 47 depending from closure member 31, which can be press or friction fit. See FIGS. 1D, 2, 3, and 5B. The diameter of the sealing plug 47 is sized to be larger than the inner diameter of the neck finish 50 of the container such that the first end 54 of neck finish 50 fits between the sealing plug 47 and the cylindrical wall 32. See FIG. 5B. The sealing plug 47 penetrates the inner diameter of the container. In an example, the sealing plug 47 may include a taper which facilitates initial engagement of the sealing plug 47 to the inner periphery of the neck finish 50 of the container opening 53. In an alternate embodiment, the cap 30 may have a liner 48 instead of the sealing plug 47 that covers the underside of closure member 31. See FIG. 1E. For example, and without limitation, the liner 48 is a molded or poured-in-liner. In examples and without limitation, the liner may be foam, foil, rubber, etc. In the example of a poured-in-liner, the liner 48 is poured into the cap 30 after molding and dried. Liner 48 provides a seal between the cap 30 and the corresponding neck finish 50. In one embodiment, threads 43 and 64 engage prior to the sealing plug 47 or the liner 48 engaging the inner diameter of the neck finish 50 when the cap 30 is applied to the neck finish 50.

A combination of the disclosed cap 30 and the neck finish 50 is also embodied herein. See FIGS. 2, 5A, and 5B. The threads of the disclosed cap 30 and neck finish 50 may enable the cap 30 to lock onto the neck finish 50 by rotating the cap 30 less than a full turn, for example and without limitation, less than 75 degrees. See FIGS. 2 and 5B. The ratchet teeth of the disclosed cap 30 and neck finish 50 along with the groove 40 and the raised portions, such as scallops 59 and pyramids 60, may secure the tamper-evident band 35 and prevent the tamper-evident band 35 from backing off once the container has been opened. The disclosed cap 30 and neck finish 50 combination may be particularly well suited to standard containers, such as blow molded beverage containers. When properly sealed, air will not penetrate through the container opening. Use of the tamper-evident band 35 makes it difficult to tamper with the contents of the container without indicating evidence thereof. The disclosed combination may also use less resin, be easier to mold, and reduce costs.

While presently preferred embodiments of the invention have been shown and described, it is to be understood that the detailed embodiments and Figures are presented for elucidation and not limitation. The invention may be otherwise varied, modified or changed within the scope of the invention as defined in the appended claims.

What is claimed is:

1. A container cap and neck finish combination comprising:

a tamper-evident cap comprising:

a circular closure member;

a cylindrical annular wall depending from the closure member having an interior threaded surface and a base; and a tamper-evident band attached to the base of the cylindrical annular wall having a plurality of teeth extending radially inward from an interior surface of the band and an annular groove in the interior surface of the band; and a neck finish comprising a cylindrical wall having an upper end portion and a lower end portion, defining an opening therethrough, wherein:

the upper end portion comprises an exterior threaded surface threadingly engaged with the interior threaded surface of the cylindrical annular wall of the tamper-evident cap; and the lower end portion comprises an exterior surface having a plurality of teeth extending radially outward therefrom engageable with the plurality of teeth extending radially inward from the interior surface of the band, and the lower end portion comprises a plurality of raised portions extending radially outward therefrom received in the annular groove of the interior surface of the band to thereby retain the band on the neck finish when the circular closure member and cylindrical annular wall of the tamper-evident cap are removed from the neck finish, wherein each of the raised portions extends radially outward from the exterior surface of the lower end portion of the cylindrical wall of the neck finish, and the plurality of raised portions are spaced between the plurality of teeth around a circumference of the lower end portion of the cylindrical wall of the neck portion.

2. The container cap and neck finish combination of claim 1, wherein the annular groove is interrupted around a circumference of the band by the plurality of teeth extending radially inward from the interior surface of the band.

3. The container cap and neck finish combination of claim 1, wherein the tamper-evident band has an upper edge and a lower edge, and the annular groove is located between the upper and lower edges of the band.

4. The container cap and neck finish combination of claim 1, wherein the annular groove has a width of from 0.01 to 0.3 inch.

5. The container cap and neck finish combination of claim 1, wherein the annular groove has a width of about 0.021 inch.

6. The container cap and neck finish combination of claim 1, wherein the tamper-evident band comprises a cylindrical sidewall having an inner diameter and a lower circular edge having an inner diameter less than the inner diameter of the cylindrical sidewall.

7. The container cap and neck finish combination of claim 1, wherein the tamper-evident band comprises a lower circular edge that does not include a radially inward extending lip.

8. The container cap and neck finish combination of claim 1, wherein each of the raised portions has a scallop shape.

9. The container cap and neck finish combination of claim 1, wherein each of the raised portions has a pyramid shape.

10. A neck finish for a container comprising a cylindrical wall having an upper end portion and a lower end portion, defining an opening therethrough, wherein:

the upper end portion comprises an exterior threaded surface; and the lower end portion comprises an exterior surface having a plurality of teeth extending radially outward therefrom and a plurality of raised portions extending radially outward therefrom, wherein the raised portions are structured and arranged to be received in an annular groove of a tamper-evident band of a cap when the cap is installed on the neck finish band to thereby retain the band on the neck finish when the circular closure member and cylindrical annular wall of the tamper-evident cap are removed from the neck finish, wherein each of the raised portions extends radially outward from the exterior surface of the lower end portion of the cylindrical wall of the neck finish, and the plurality of raised portions are spaced between the plurality of teeth around a circumference of the lower end portion of the cylindrical wall of the neck portion.

11. A container cap and neck finish combination comprising:

a tamper-evident cap comprising:

a circular closure member;

a cylindrical annular wall depending from the closure member having an interior threaded surface and a base; and a tamper-evident band attached to the base of the cylindrical annular wall having a plurality of teeth extending radially inward from an interior surface of the band and an annular groove in the interior surface of the band; and a neck finish comprising a cylindrical wall having an upper end portion and a lower end portion, defining an opening therethrough, wherein:

the upper end portion comprises an exterior threaded surface threadingly engaged with the interior threaded surface of the cylindrical annular wall of the tamper-evident cap; and the lower end portion comprises an exterior surface having a plurality of teeth extending radially outward therefrom engageable with the plurality of teeth extending radially inward from the interior surface of the band, and the lower end portion comprises a plurality of raised portions extending radially outward therefrom received in the annular groove of the interior surface of the band to thereby retain the band on the neck finish when the circular closure member and cylindrical annular wall of the tamper-evident cap are removed from the neck finish, wherein the plurality of raised portions are located on the plurality of teeth of the lower end portion of the cylindrical wall of the neck portion.

* * * * *